United States Patent [19]

Frykhult

[11] 4,333,572

[45] Jun. 8, 1982

[54] SEPARATION OF PULP FLOW

[75] Inventor: Rune H. Frykhult, Huddinge, Sweden

[73] Assignee: AB Celleco, Stockholm, Sweden

[21] Appl. No.: 216,560

[22] Filed: Dec. 15, 1980

[30] Foreign Application Priority Data

Dec. 18, 1979 [SE] Sweden ..... 7910404

[51] Int. Cl.[3] ..... D21D 5/16; D21D 5/24

[52] U.S. Cl. ..... 209/17; 209/211; 209/250

[58] Field of Search ..... 209/17, 211, 250; 210/512.1, 304

[56] References Cited

U.S. PATENT DOCUMENTS

| | | | |
|---|---|---|---|
| 3,425,545 | 2/1969 | Zemanek et al. | 209/211 X |
| 3,499,528 | 3/1970 | Salomon | 209/273 |
| 3,805,401 | 4/1974 | Fontein | 209/250 X |
| 4,134,827 | 1/1979 | Frykhult | 209/211 |

*Primary Examiner*—Ralph J. Hill

*Attorney, Agent, or Firm*—Cyrus S. Hapgood

[57] ABSTRACT

The method is intended for separating a flow of pulp containing impurities of coarse particles, partly light and partly heavy particles, by means of a main sieve or the like, into at least one pulp flow and one coarse reject flow. The coarse reject flow is separated by a hydrocyclone separator of a known type into a pulp flow, a light reject flow and a heavy reject flow. Advantageously, the light reject flow is separated by a bow sieve into a flow enriched in light particles and a flow enriched in fibers and which may be returned to the main sieve.

3 Claims, 3 Drawing Figures

SEPARATION OF PULP FLOW

This invention relates to a method for separating a flow of pulp containing impurities of coarse particles, partly light and partly heavy particles, by means of a device like a sieve, into at least one pulp flow and one coarse reject flow containing substantial amounts of the coarse particles and pulp.

In such separations in sieves, which are common in the pulp industry, the outlets from the sieve for the coarse reject flow must be provided with a large cross-sectional area so that these outlets will not be plugged by the coarse impurities. As the pressure is generally high in the outlets, a substantial part of pulp will accompany the coarse particles in the coarse reject flow. Usually about 5% of the pulp suspension is discharged with the coarse reject flow. In most cases it is necessary to use a second sieve for recovery of pulp from the coarse reject flow. A suitable second sieve is the open vibration sieve.

When using vibration sieves, the advantage is gained that only a minor amount of valuable pulp is lost with the coarse impurities; but these sieves have disadvantages such as high installation cost, a relatively high maintenance cost, vibrations, a high noise level, and difficulty in adjusting operational parameters such as amplitude.

The principle objective of the present invention is to provide a method of the type first described which does not have the disadvantages typical of methods in which a vibration sieve is used for recovery of pulp from the coarse reject flow.

According to the invention, the method is characterized in that the coarse reject flow from the sieve is separated by a hydrocyclone separator, of a type known in the separator art, into a pulp flow, a light reject flow and a heavy reject flow.

In one embodiment of the invention, the light reject flow is separated by a bow sieve into a flow enriched in light particles, which do not pass through the bow sieve, and into a flow enriched in fibers and which is preferably combined with said pulp flow.

It may be desirable to dilute the heavy reject flow from the main sieve by a diluting liquor before the heavy reject flow is introduced into said hydrocyclone separator, if its concentration or viscosity should be too high for an orderly function of the latter separator.

If the pressure in the main sieve is too low to make the heavy reject flow drive the hydrocyclone separator, said diluting liquor can be fed in such a way that it contributes to the operation of the hydrocyclone separator.

A system for carrying out the method of the invention is characterized by a reasonable installation cost, a minor maintenance cost, freedom from vibrations, a low noise level and high operational capability.

BRIEF DESCRIPTION OF THE DRAWINGS

The invention will now be described more in detail, reference being made to the accompanying drawing in which.

DETAILED DESCRIPTION

Figure 1:
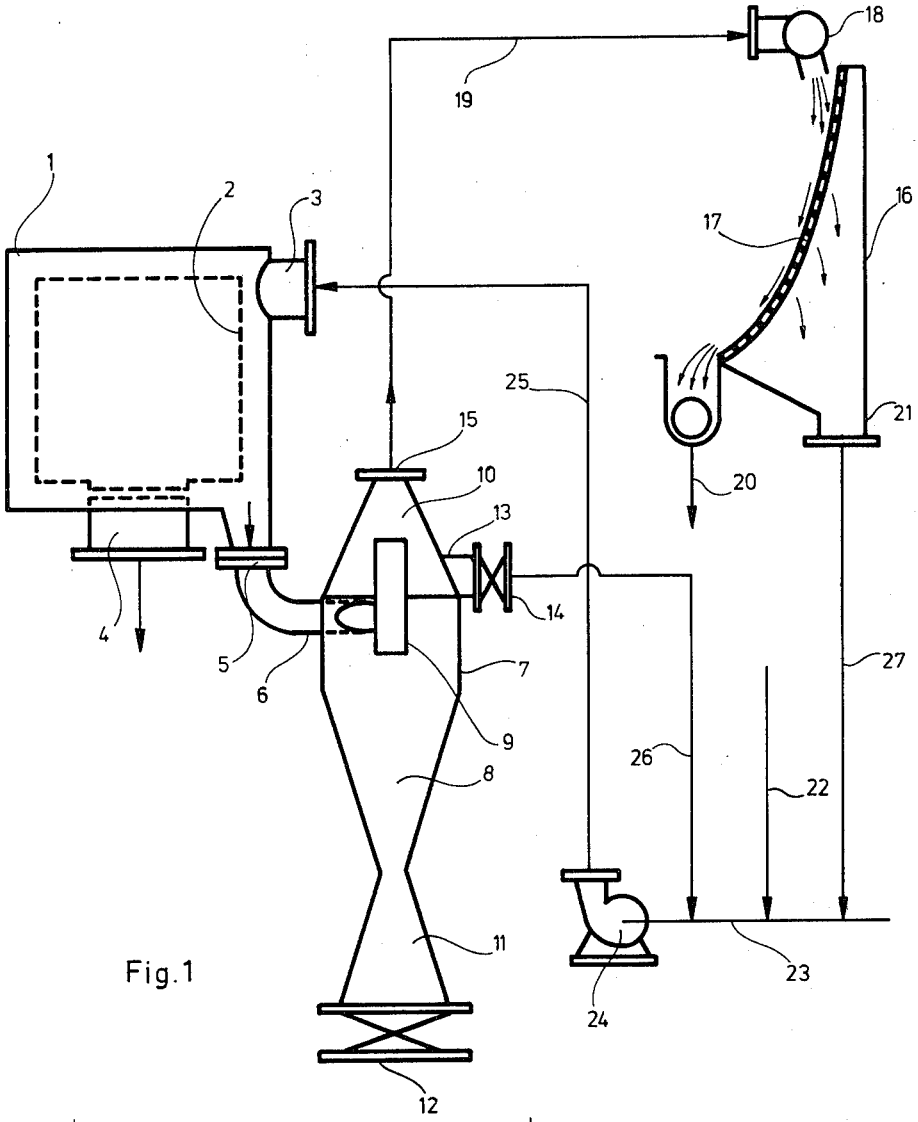
FIG. 1 is a schematic view of a system for carrying out the method according to the invention.

In FIG. 1, a sieve 1 has a sieve means 2, an inlet 3 for an incoming flow, an outlet 4 for a discharged pulp flow and an outlet 5 for a coarse reject flow, which is connected to a tangential inlet 6 of a hydrocyclone separator 7. The latter is provided with a first separation chamber 8 which is connected, via a central outlet 9, to a second separation chamber 10. The first separation chamber 8, which conventionally comprises a circular cylindrical part and a conical part, ends in a reject collecting chamber 11 which is closed by a valve 12. The second separation chamber 10 is provided with a peripheral outlet 13, having a valve 14, and with a central outlet 15. Such a hydrocyclone separator 7 is known from Swedish patent application No. 7909420-7, and admits an incoming flow to be separated into three outgoing flows. There are other known embodiments of such a hydrocyclone separator, but the one disclosed in FIG. 1 is especially advantageous.

As shown in FIG. 1, a bow sieve 16 is provided with a sieve means 17. The outlet 15 is connected to the inlet 18 of the bow sieve via a line 19. The bow sieve 16 has an outlet 20 for a flow enriched in light particles and an outlet 21 for a flow of fibers.

The incoming pulp suspension is fed through a line 22 connected to a manifold line 23, which in turn is connected to a pump 24 from which a line 25 leads to the inlet 3 of the sieve 1. A line 26 from the outlet 13 of the hydrocyclone separator 7 and a line 27 from the fiber flow outlet 21 of the bow sieve 16 are also connected to the manifold line 23.

A condition for the system in FIG. 1 to operate is that there is an overpressure in sieve 1 which is high enough to drive the hydrocyclone separator 7. Furthermore, the concentration and the viscosity in the coarse reject flow discharged from the outlet 5 are such that this flow is treatable in the hydrocyclone separator 7.

In operation, the coarse reject flow streams tangentially through inlet 6 into the first separation chamber 8 of the hydrocyclone separator 7, the heaviest particles being collected in the reject collecting chamber 11, which may be discharged intermittently even if a continuous heavy reject flow would also be possible. An intermediate fraction streams through the outlet 9 into the second separation chamber 10 (the outlet 9 acting as an inlet into chamber 10) and is separated into a light reject flow, which is discharged through the outlet 15 to a line 19, and a pulp flow which is recirculated to the sieve 1 via the outlet 13, the line 26, the pump 24 and the line 25. The valve 14 can be used for regulating the proportion between the light reject flow and the pulp flow. The light reject flow from line 19 is separated in the bow sieve 16 into a flow enriched in light particles, which is discharged at 20, and a fiber flow which is recirculated to the sieve 1 by the pump 24.

Figure 2:
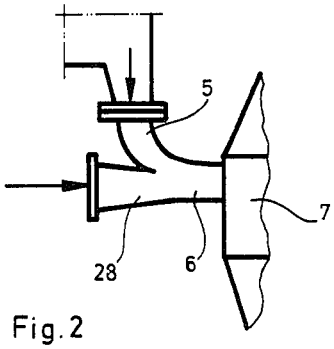
FIG. 2 is a similar view of an alternative embodiment of a detail in the system of FIG. 1.

If the pressure in the sieve 1 is not sufficient for driving the hydrocyclone separator 7, and the concentration or viscosity of the coarse reject flow from the outlet 5 is so high that the hydrocyclone separator does not operate for that reason, the inlet to the hydrocyclone separator 7 can be designed in the manner disclosed in FIG. 2. Through an inlet 28, diluting liquor is fed at such a rate that the concentration and the viscosity become suitable for operation of the hydrocyclone separator 7. The diluting liquor entering through the main direction of the inlet 6 contributes to operating the hydrocyclone separator, and an ejector action facilitates the inflow of the coarse reject flow through the inlet 6.

Figure 3:
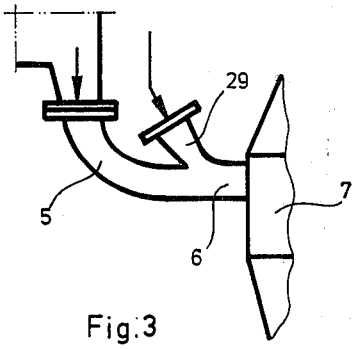
FIG. 3 is a similar view of another alternative embodiment of a detail of the system of FIG. 1.

If, on the other hand, the pressure in the sieve 1 is enough in itself for driving the hydrocyclone separator 7, but the concentration and the viscosity are too high, diluting liquor can be introduced to the inlet 6 as shown in FIG. 3, where an inlet 29 for diluting liquor is arranged in such a way that the coarse reject flow sucks diluting liquor by ejector action.

In the disclosed system, all flow areas can be dimensioned large enough to avoid plugging problems, without losing fibers. In this way a safe operation of the sieve 1 is achieved, and at the same time the advantages of reduced environmental problems and better fiber economy are gained.

I claim:

1. A method for separating a pulp-containing stream having impurities which are partly relatively light coarse particles and partly relatively heavy coarse particles, said method comprising the steps of feeding said stream to a sieving locus and there separating the flow into at least one pulp flow and one coarse reject flow, said coarse reject flow containing substantial amounts of the coarse particles and pulp, feeding the coarse reject flow into a hydrocyclone separator and there separating said reject flow into three separate flows, namely, a second pulp flow, a heavy reject flow containing a substantial amount of said relatively heavy particles, and a light reject flow containing a substantial amount of said relatively light particles, and feeding said light reject flow to a bow sieving locus and there separating the light reject flow into a flow enriched in light particles, which do not pass through the bow sieve, and a flow enriched in fibers.

2. The method of claim 1, comprising also combining at least part of said flow enriched in fibers with said second pulp flow.

3. The method of claim 1, comprising also returning at least part of said second pulp flow and at least part of said flow enriched in fibers to said sieving locus to which said stream is fed.

* * * * *